United States Patent [19]

Zellmer

[11] 3,931,917

[45] Jan. 13, 1976

[54] PERSONAL MATERIALS CARRIER

[76] Inventor: Donal R. Zellmer, USA Aero Services DETE, APO New York, N.Y.

[22] Filed: Mar. 12, 1973

[21] Appl. No.: 340,394

[52] U.S. Cl. ..... 224/5 R; 224/17; 224/22

[51] Int. Cl.[2] ..... A45F 5/00; F42B 39/02

[58] Field of Search ..... 224/5 R, 5 A, 5 G, 5 K, 224/5 MC, 5 BC, 26 R, 26 B, 14, 13, 22, 23, 17; 2/300, 310, 311, 312

[56] References Cited

UNITED STATES PATENTS

| | | | |
|---|---|---|---|
| 776,193 | 11/1904 | Mills | 224/23 |
| 1,016,231 | 1/1912 | Robie | 224/22 |
| 1,110,694 | 9/1914 | Jennings | 224/22 |
| 1,502,414 | 7/1924 | Washuk | 2/312 |
| 2,048,498 | 7/1936 | Foster | 224/5 R |
| 2,732,111 | 1/1956 | Fogle | 224/17 |
| 3,599,238 | 8/1971 | Matthews | 2/310 X |

FOREIGN PATENTS OR APPLICATIONS

| | | | |
|---|---|---|---|
| 377,958 | 6/1940 | Italy | 224/26 (3) |
| 914 | 1/1901 | United Kingdom | 224/22 |
| 487,918 | 5/1918 | France | 224/5 R |

*Primary Examiner*—Robert J. Spar
*Assistant Examiner*—Jerold M. Forsberg
*Attorney, Agent, or Firm*—James C. Wray

[57] ABSTRACT

A personal materials carrier is constructed of a curved band of material having a frontal diagonal chest-overlying portion, a shoulder-overlying portion connected to the chest-overlying portion at an angle to cause the chest-overlying portion and shoulder-overlying portion to lie flat, a back portion connected to the shoulder portion at an angle and a waist portion connected to the back portion. The bottom of the chest-overlying portion and a front of the side portion are joined together substantially perpendicularly in completion of the band. Pockets on the chest-overlying portion open inward and upward, and pockets near an upper extremity of the chest portion open upward. Pockets on the side portion open upward, and a pocket at the forward edge of the side portion opens rearward within the band.

10 Claims, 3 Drawing Figures

PERSONAL MATERIALS CARRIER

BACKGROUND OF THE INVENTION

Money belts and pouches have been well known. Usually the money belts have slender zippered pockets which hold a quantity of money in a flat arrangement. Money belts of conventional design are worn around the waist beneath the clothing of the wearer to conceal money and to protect the money from casual robbery attempts or loss. A collection of money belts which is indicative of the state of the art in that area is found in Class 224, subsclass 26 of the U.S. Patent Office files of patents. Some belts found within that classification have pockets for varied purposes. Examples of prior art devices are found in the belt purse of U.S. Pat. No. 1,289,186, the fishermen's belt of U.S. Pat. No. 1,486,470, the vest belt of U.S. Pat. No. 1,558,228 and the secret compartment belt of U.S. Pat. No. 2,503,157.

All of the prior art devices have pockets opening in uniform directions and describe devices formed in flat regular bands which may be closed in flat regular loops as belts.

Recent trends in clothing have provided fewer places to carry necessary personal materials. Suits and slacks being more closely fitted have less tolerance for the carrying of personal articles in pockets. Trends away from men's suits to more casual attire have created problems in providing adequate places to carry usual and ordinary personal supplies. Shirts are constructed with no pockets at all. Trousers are closely fitted, so that pockets become useless. The problem has been recognized by the development and marketing of men's shoulder bags or other carriers which are intended primarily for the use with ordinary personal materials which an individual usually carries.

The conventional use of ladies' handbags has for a long time recognized the non-availability of pockets in which to carry materials in women's clothes.

SUMMARY OF THE INVENTION

The present invention provides a means for carrying personal articles without the necessity for interrupting clothing lines and without the necessity for remembering and transporting shoulder bags or handbags. Broad objectives of the invention are accomplished by providing a band draped over a shoulder of an individual on one side and partially encircling a waist of the wearer on the opposite side and having a plurality of inward and upward facing pockets of varied size and opening directions for carrying personal materials.

In a preferred form of the invention, the personal materials carrier is constructed as a band which has a chest-overlying portion with a plurality of varied-size pockets opening upward perpendicular to the diagonal line on which the band overlies the chest of a wearer. The chest portion is supported by a shoulder portion which is connected to an upper end of the chest portion. Preferably, the connection is made at a slight angle to insure that the shoulder portion and chest portion lie flat on the body of a wearer. A back portion is joined to the shoulder portion preferably at an angle to insure flatness. The back portion extends downward diagonally across a back of a wearer and is connected to a side portion which is in turn connected to a lower end of the chest portion.

In a preferred form of the invention, the band is closed by fasteners at the bottom of the chest portion and at the front of the side portion. Two or more complementary fasteners are employed. The fasteners are oriented across the longitudinal end of the chest portion and perpendicular to the longitudinal end of the side portion, along one elongated edge thereof. In another embodiment of the invention, the ends of the band are permanently joined to form a permanent loop which is worn in the same manner. When the permanent loop is folded and is flattened, it has a slight angle which is indicative of the angular relation between the shoulder portion and chest and back portions. In an alternate form of the invention, the chest and side portions are permanently joined, and fasteners connect separate sections of the carrier at or near a shoulder of the wearer.

The pockets of the carrier generally open in the direction of the head and opposite arm of the wearer. Pockets in the chest portion preferably open upward, generally perpendicular to the elongated direction of the belt. Several pockets of varied size are usually included on the chest portion. The carrier may be worn with the pockets on the outside, or it may be reversed and draped across the other shoulder with the pockets on the inside. In one embodiment of the invention, the pockets are constructed without fasteners or flaps. Snap or zipper fasteners may be provided, or miniature loop and hook fasteners may be used. In another embodiment, a single flap covers all pockets or some pockets. Other pockets are closed by individual flaps which may have snap fasteners. When it is desired not to use the flaps, they may be folded in back of the interior between the carrier and the body.

Pockets for change and other similar items are included along the waist portion. A concealed pocket extends rearward from the forward end of the waist portion. Pockets on the back portion and on the shoulder portion are used to carry infrequently used items.

Along the side portion, and at the junction of the side portion and chest portion, one or more grommets or suspension type fasteners are employed for carrying other, bulky items of personal use. Dependent fastener means connected to the partial waist-encircling portion support suspended articles beneath the waist portion.

One object of the invention is the provision of a personal materials carrier for draping over one shoulder and across the body and partially around the waist and having several pockets for carrying personal materials.

Another object of the invention is the provision of a personal materials carrier having a front portion which extends diagonally across a chest of a wearer and which has upward opening pockets, a shoulder portion which is connected at an angle to the chest portion, and a back portion which is connected at an angle to the shoulder portion and a waist portion in continuation of the back portion which fastens to a lower end of the chest portion for carrying articles of a personal use nature.

These and other objects and features of the invention are apparent in the disclosure which includes the drawings and the foregoing and ongoing description with its appended claims which form a part of the original disclosure.

DETAILED DESCRIPTION OF THE DRAWINGS

Figure 1:
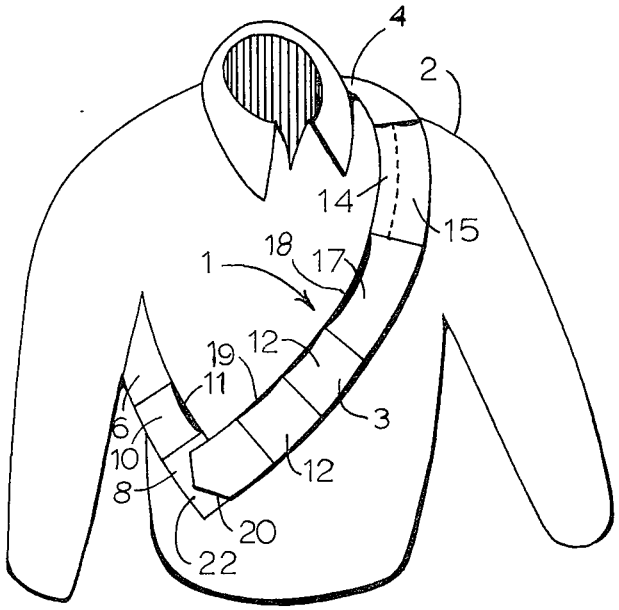
FIG. 1 is a perspective view of the personal effects carrier draped over a jacketed form of a user.
Figure 2:
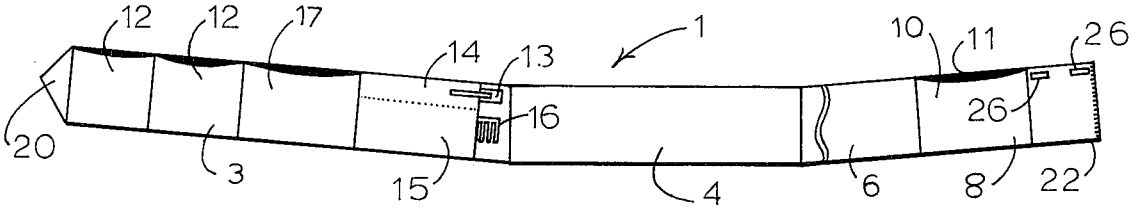
FIG. 2 is a detail of a front of the carrier.
Figure 3:
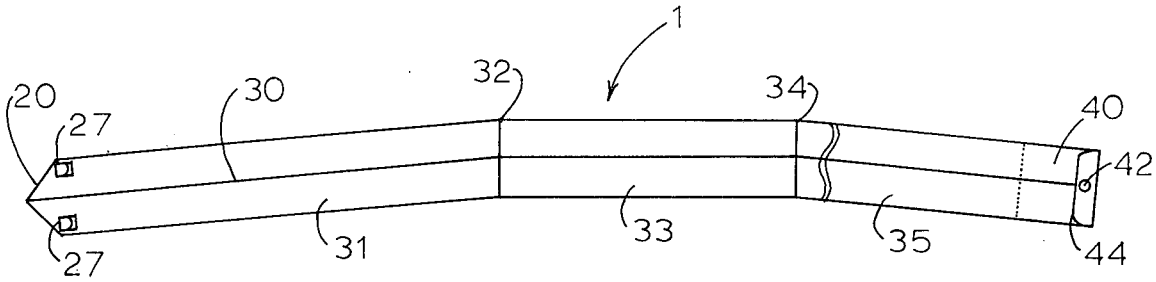
FIG. 3 is a rear elevation of the carrier.

With references to FIGS. 1, 2 and 3 a personal materials carrier is generally indicated by the numeral 1. Carrier 1 is shown draped on a jacketed form 2 which represents an attired body of a user.

Carrier 1 is made up of a diagonal chest-overlying portion 3, a shoulder portion 4 which is connected to the upper end of chest portion 3, a back portion 6 and a side portion 8, all connected together in a loop. For purposes of emphasis, the back portion 6 is displayed in the present drawing, whereas the back portion normally would lie beyond the plane of the drawing. At the same time, in preferred embodiments, side portion 8 would extend generally horizontally between the back portion and the chest portion. A pocket 10 having an upward opening 11 is mounted on side portion 8 for carrying loose materials such as change. Pockets 12 are mounted in chest portion 3 and are of an appropriate size for carrying articles such as credit and identification cards, licenses and the like. In the embodiment shown in the drawing, upward opening pockets 14 and 15 are positioned near the shoulder portion to carry long thin articles such as a pen 13 and a comb 16.

An elongated pocket 17 has an elongated inward opening 18 for receiving a flat wallet, or a similar article. In a like manner, pockets 12 have upward and inward openings 19 for receiving the identifying cards such as credit cards and licenses which a person usually carries.

In one form of the invention, the carrier is constructed in a releasable form with free and lower end 20 of chest portion 3 joined to free end 22 of the waist portion. In an alternate form, ends 20 and 22 may be permanently joined, and the carrier may be placed on the body by placing the right arm and head through the continuous loop. In another from of the invention, the shoulder portion 4 may be divided into front and back shoulder portions with complementary snap fasteners for completing the loop.

As shown in FIG. 2 in the present embodiment, the free end 22 of the side section is provided with metallic rectangular loops 26 along a horizontal elongated edge. In FIG. 3, complementary rectangular metallic hooks 27 are mounted transverse to a longitudinal direction of the carrier to cooperate with loops 26 in holding the ends substantially perpendicular.

As shown in FIG. 3, the carrier body is formed as a longitudinal tube with an inverted seam 30 and sharply pressed longitudinal edges. Darts 32 and 34 change the longitudinal direction between the rear sections 31, 33 and 35 to improve the lie or drape of the carrier on the body.

A pocket 40 is shown formed in the end of the carrier. Fastener 42 holds flap 44 closed to secure the items within the pocket 40.

Sizes and shapes of the carrier may vary as is convenient. For illustrative purposes, the back and side sections which are integrally formed are foreshortened to provide greater detail of the elements.

Although the invention has been described with reference to a specific embodiment, it will be obvious to those skilled in the art that modifications and variations of the invention may be made without departing from the spirit and scope of the invention. The scope of the invention is defined in the following claims:

I claim:

1. Shoulder-mounted personal materials carrier apparatus comprising a curved band for positioning on a body of a wearer, the carrier band having a diagonal chest-overlying portion for extending from a lateral waist area to a position adjacent an opposite shoulder area, a shoulder-overlying portion connected to an upper end of the diagonal chest-overlying portion, the shoulder-overlying portion being configured for lying flat upon a shoulder, and wherein the shoulder-overlying portion and the chest-overlying portion are connected at obtuse angles to make the carrier band lie flat against the body, a back portion connected to the shoulder-overlying portion remote from the diagonal chest-overlying portion and extended downward, a partial waist-encircling portion connected to the back portion remote from the shoulder-overlying portion and extended forward to a lateral waist area, where the partial waist-encircling portion is connected to a lower end of the diagonal chest-overlying portion at a generally perpendicular angle, and a plurality of varied pockets in the carrier band, the pockets having openings in varied directions.

2. The personal materials carrier apparatus of claim 1 wherein the chest-overlying portion and the partial waist-encircling portion are joined substantially perpendicularly by fasteners at ends of the chest-overlying portion and the partial waist-encircling portion.

3. The personal materials carrier apparatus of claim 2 wherein two fasteners are arranged along an elongated edge of the partial waist-encircling portion and two complementary fasteners are arranged along a short terminal edge of the chest-overlying portion.

4. The personal materials carrier apparatus of claim 1 wherein the curved carrier band is formed of integrally joined portions in one continuous band of material.

5. The personal materials carrier apparatus of claim 1 wherein the carrier band is formed of integrally joined portions in a substantially continuous tube of material on which pockets are outwardly stitched.

6. The personal materials carrier apparatus of claim 1 wherein the pockets comprise square and elongated rectangular pockets mounted side-by-side along the chest-overlying portion, the pockets having openings in edges thereof facing an opposite shoulder of the wearer.

7. The personal materials carrier apparatus of claim 6 further comprising parallel elongated pockets extending upward and opening in the direction of the shoulder-overlying portion.

8. The personal materials carrier apparatus of claim 1 further comprising a large upward opening pocket in the partial waist-encircling portion.

9. The personal materials carrier apparatus of claim 1 further comprising an end pocket in the partial waist-encircling portion, the end pocket opening at an edge of the partial waist-encircling portion and extending rearward within the waist portion.

10. The personal materials carrier apparatus of claim 1 further comprising fastener means connected to the partial waist-encircling portion for supporting suspended articles beneath the waist portion.

* * * * *